US005875927A

United States Patent [19]

D'Andrade

[11] Patent Number: 5,875,927

[45] Date of Patent: Mar. 2, 1999

[54] TOY GUN HAVING AN EXPANDABLE TEAR DROP SHAPED BLADDER FOR EJECTION OF LIQUID THEREFROM

[76] Inventor: Bruce M. D'Andrade, 3 Ten Eyck Rd., Whitehouse Station, N.J. 08889

[21] Appl. No.: 905,386

[22] Filed: Aug. 4, 1997

[51] Int. Cl.[6] ..... A63H 3/18

[52] U.S. Cl. ..... 222/79; 222/183; 222/386.5

[58] Field of Search ..... 222/79, 95, 105, 222/183, 212, 209, 215, 386.5, 385, 383.1, 253

[56] References Cited

U.S. PATENT DOCUMENTS

| | | | |
|---|---|---|---|
| 275,997 | 4/1883 | Chapelain | 222/79 |
| 600,552 | 3/1898 | Parker | 222/79 |
| 605,430 | 6/1898 | Humphrey | 222/79 |
| 617,495 | 1/1899 | Reimann | 222/79 |
| 688,882 | 12/1901 | Parker | 222/79 |
| 2,513,506 | 7/1950 | Mendelson | 222/79 X |
| 2,802,298 | 8/1957 | Larin | 222/79 X |
| 3,876,115 | 4/1975 | Venus, Jr. et al. . | |
| 4,121,737 | 10/1978 | Kain . | |
| 4,135,559 | 1/1979 | Barnby . | |
| 4,458,830 | 7/1984 | Werding . | |
| 4,854,480 | 8/1989 | Shindo | 222/79 |
| 5,032,100 | 7/1991 | Goldfarb . | |
| 5,292,032 | 3/1994 | Johnson et al. | 222/79 |
| 5,366,108 | 11/1994 | Darling | 222/79 X |
| 5,531,627 | 7/1996 | Deal | 222/79 X |

*Primary Examiner*—Kevin P. Shaver
*Attorney, Agent, or Firm*—Panitch Schwarze Jacobs & Nadel, P.C.

[57] ABSTRACT

The present invention is an expandable tear drop shaped bladder toy gun for subsequent ejection of liquid therefrom. It includes a main housing having a liquid ejection nozzle, a handle and a trigger, as well as an inflatable tear drop shaped bladder connected to or encompassed in the main housing, and includes a single inlet/outlet tube connected to the bladder. There is also a storage tank for supplying liquid, e.g. water, thereto, as well as a hand pump connected to both the storage tank and the bladder. The pump is physically connected to the housing and functionally connected to the storage tank and the bladder inlet. There is a bladder release valve having an upstream side and a downstream side. The bladder release valve is connected to the bladder outlet at the valve's upstream side, and is connected to the trigger for opening and closing thereof, and is connected to the nozzle at the valve's downstream side for subsequent liquid ejection when the trigger is pulled.

15 Claims, 3 Drawing Sheets

TOY GUN HAVING AN EXPANDABLE TEAR DROP SHAPED BLADDER FOR EJECTION OF LIQUID THEREFROM

BACKGROUND OF THE INVENTION

1. Field of the Invention

The present invention is directed to expandable bladder toy guns for liquid ejection therefrom. More specifically, the toy gun of the present invention relies upon an expandable, tear drop shaped bladder for release of liquid such as water, wherein the liquid is first stored in a fill tank and is then pumped into the tear drop shaped bladder and expands the tear drop shaped bladder for pressurized bladder containment of the liquid until subsequent trigger release.

2. Information Disclosure Statement

The following patents represent development in bladder-containing toy guns (air and water) as well as other water guns:

U.S. Pat. No. 5,373,833 to D'Andrade describes a projectile-shooting air gun. It includes a main housing which has a barrel adapted for receiving a projectile, a handle and a trigger, as well as a high pressure, inflatable bladder connected to the main housing, the bladder has an inlet and an outlet. There is also a pressurizing mechanism for providing air pressure to the bladder to inflate it. The pressurizing mechanism is physically connected to the housing and functionally connected to the bladder inlet. There is a bladder deflation valve which is connected to the trigger for opening and closing thereof, and it is connected to a projectile launch tube for launching a projectile upon deflation of at least a portion of the bladder. The launch tube is located in the barrel of the main housing and connected to the bladder deflation valve, and adapted for receiving and shooting a projectile.

U.S. Pat. No. 5,032,100 to Goldfarb describes a toy vehicle and launcher combination apparatus. The illustrated toy vehicle has a rubber bladder or chamber member that is expanded by water or other liquid under pressing while the vehicle is held on the launcher. The launcher may include a reservoir and pump to provide the water under pressure. When the chamber member is sufficiently expanded, the vehicle is released. A spring gives the vehicle an initial forward thrust; the expanded chamber member contracts to expel the water through a rear outlet nozzle to propel the vehicle forward at a rapid rate.

U.S. Pat. Nos. 4,991,847 and 4,890,838 to Rudell et al. both describe a timed water release toy. There is disclosed a ball having a foraminous outer shell with an inner membrane which forms an interior closure within the outer shell and with a timer and a release mechanism operative to open the inner membrane and release its contents after the time on the timer expires. The contents spill through the foraminous outer shell, wetting the player who is handling or catching the ball at the moment of release. The timer is activated and the ball is used in a game in which it is tossed between participants who seek to avoid becoming wet when the timer releases the water from the interior closure of the ball.

U.S. Pat. No. 4,892,081 Randall Morrmann sets forth a compressible ball launcher which relies upon a telescoping cylindrical gun to compress water to force a ball out of a nozzle.

U.S. Pat. No. 4,854,480 to Shindo describes a long range trigger-actuated squirt gun. The squirt gun includes a hollow housing in the form of a gun with a liquid dispensing assembly within the housing. The liquid dispensing assembly includes a rubber tube, expandable upon being filled with liquid, which is connected to a rigid tube with a nozzle at one end, and will dispense liquid from the rubber tube through the nozzle. A pivotable trigger is mounted with one end located to squeeze the rubber tube against the housing. A rigid coil around the rubber tube between the trigger and rigid tube restrains the rubber tube from expansion for the length of the coil. An adapter is provided which is threadable on a faucet, for filling the rubber tube in the squirt gun with water.

U.S. Pat. No. 4,735,239 to Salmon et al. describes a liquid projecting device. The device uses an elastic tubular bladder for receiving liquid which is expandable radially generally spherically at a local segment until a fully-expanded cross-section is achieved at which time the expanded region begins to grow axially, thereby maintaining a relatively constant pressure independent of bladder volume. The device is provided with a nozzle and a valve for controlling and directing the flow of the projected liquid.

U.S. Pat. No. 4,458,830 to Werding describes an appliance for discharging a non-compressible liquid, creamy or pasty product under pressure. The container of rigid material comprises an appliance which employs the contractional force of an expanded rubber hose and an expanded product container for the discharge of a medium stored therein. A hollow body of elastic material located in the axis of a product container is provided with a valve at one end through which it is inflated. The shape of the inner walls for the rigid container limits a radial, diagonal-radial and axial expansion of the appliance in a predetermined ratio, whereby the medium acts upon the inflated hollow body in such a way that the volume of the latter decreases, whereby its inner pressure increases and gives it a tendency to expand. If the squeezing pressure exerted by the rubber hose and the product container upon the medium decreases, the hollow body can expand accordingly and thus compensate the loss of contraction pressure.

U.S. Pat. No. 4,257,460 to Paranay et al. describes a water gun. The novel water gun is disclosed herein having a body formed with a central bore opening at its opposite ends to provide a discharge nozzle at one end of the body and a storage compartment or reservoir end at the opposite end of the body. The storage compartment end is adapted to releasably hold the end of an inflatable member which when loaded with water under pressure, expands so as to stretch the membrane of the inflatable storage compartment. Upon termination of the loading pressure, the inflatable member collapses under its own elasticity to discharge the stored water via the nozzle end of the body. A clamping device is employed for detachably connecting the inflatable storage compartment to its respective end of the body, and a trigger mechanism may be employed for selectively releasing the pressurized water within the storage compartment.

U.S. Pat. No. 4,135,559 to Barnby describes a water squirt toy and fill valve combination. The water squirt toy apparatus includes a combination of a water squirt toy and a special filling valve which function together-cooperatively. The water squirt toy includes a resiliently expansible tubular member serving as a water reservoir and encased within a rigid tubular support member, and a manually operated, lever-type, normally closed valve mechanism operatively associated with the expansible member for permitting or preventing fluid discharge therefrom by compressing or pinching the same. The frontward end of the expansible member is fixedly, but removably, secured to a discharge opening. The filling valve is particularly structured for fluidically mating with a conventional hose bib or hose as well as with the discharge opening in order to permit easy and rapid filling and refilling of the expansible member with water. The discharge opening may also mate directly with the hose bib or hose without the special valve. An injector is also provided for operative connection to the filling valve for injecting chemicals in to the water supply whereby the discharged streams will coalesce and exhibit reduced separation so as to be discharged over significantly greater distances; and amusement apparatus which is particularly adaptable for use with the water squirt toy is also disclosed. A weakened annular portion of the tubular member is utilized to insure that the expansion begins frontward and progresses rearwardly.

U.S. Pat. No. 4,121,737 to Kain describes an apparatus for pressure dispensing of fluid products having an elastomeric pressure unit disposed in a surrounding relationship to a flexible, fluid-tight liner. The liner has its open end sealably engaged with a valve support, having a dispensing valve therein. The inherent contracting force which returns an expanded elastomeric pressure unit to its normal unexpanded position, provides the dispensing pressure for the product contained within the flexible liner, while the liner prevents contact between the product and the elastomeric material of the pressure unit.

U.S. Pat. No. 3,876,115 to Venus, Jr. et al describes a fluid container especially adapted for the fluid storage and dispensing of a fluid without the use of a propellant or the like. The container utilizes a first expansible lilt bladder which is substantially compatible with the material or fluid to be stored therein and which in most instances, is fluid impervious or material impermeable. The first bladder does not materially contribute to exerting an expelling force on the material stored within and consequently, a second expansible bladder substantially coextensive with the first one is provided wherein the material from which the second bladder is constructed has a high-elastic memory so that upon the filing of a first bladder with a stored fluid, the expansion of the first bladder causes equal expansion of the second bladder to thereby exert a dispensing force upon the material or fluid stored within the first expansible bladder. A novel container utilizing the double bladder concept is also disclosed. Applications of the invention other than containers are also disclosed.

U.S. Pat. No. 3,486,539 to Candido Jacuzzi describes a liquid dispensing and metering assembly. The liquid dispensing and metering assembly in which an expandable receptacle of a material adapted to maintain constant pressure characteristics over a substantial change in volume of liquid content of such receptacle, discharges through a slow rate metering-element to provide a uniform discharge flow at a low constant pressure.

U.S. Pat. No. 2,237,678 issued to Raymond Lohr et al describes a repeating, cork shooting toy which utilizes a cork magazine which rotates after each firing to position the next cork in sequence for firing.

Notwithstanding the foregoing, the prior art neither teaches nor suggests the use of an expandable tear drop shaped bladder, pumped up by a pump on a toy gun with liquid from a tank, to subsequently release liquid therefrom, as in the present invention.

SUMMARY OF THE INVENTION

The present invention is an expandable tear drop shaped bladder toy gun for subsequent ejection of liquid therefrom. It includes a main housing having a liquid ejection nozzle, a handle and a trigger, as well as an inflatable tear drop shaped bladder connected to or encompassed in the main housing, and includes a single inlet/outlet tube connected to the bladder. There is also a storage tank for supplying liquid, e.g. water, thereto, as well as a hand pump connected to both the storage tank and the bladder. The pump is physically connected to the housing and functionally connected to the storage tank and the bladder inlet. There is a bladder release valve having an upstream side and a downstream side. The bladder release valve is connected to the bladder outlet at the valve's upstream side, and is connected to the trigger for opening and closing thereof, and is connected to the nozzle at the valve's downstream side for subsequent liquid ejection when the trigger is pulled. The bladder has a predetermined expansion size to which it is capable of being expanded, and the bladder housing has a predetermined volume and encompasses the tear drop shaped bladder. The predetermined volume of the bladder housing is sized less than the predetermined maximum expansion size of the bladder to limit the maximum expansion of the bladder during filling.

BRIEF DESCRIPTION OF THE DRAWINGS

The present invention is more fully understood when the present specification is taken in conjunction with the drawings appended hereto, wherein.

DETAILED DESCRIPTION OF THE PRESENT INVENTION

The present invention toy gun has been developed to provide high powered, safe shooting of liquid, such as water, while being fully self-contained, i.e. without the need for pressurized gas canisters or batteries or external pressurizing means such as pressurized water from a garden hose or faucet. The toy gun of the present invention also provides relatively constant pressure throughout the duration of the shot. It relies upon manual pumping to fill a unique, tear drop shaped bladder with liquid which will hold the liquid under pressure created by elastic bladder expansion for subsequent ejection by trigger release.

Figure 1:
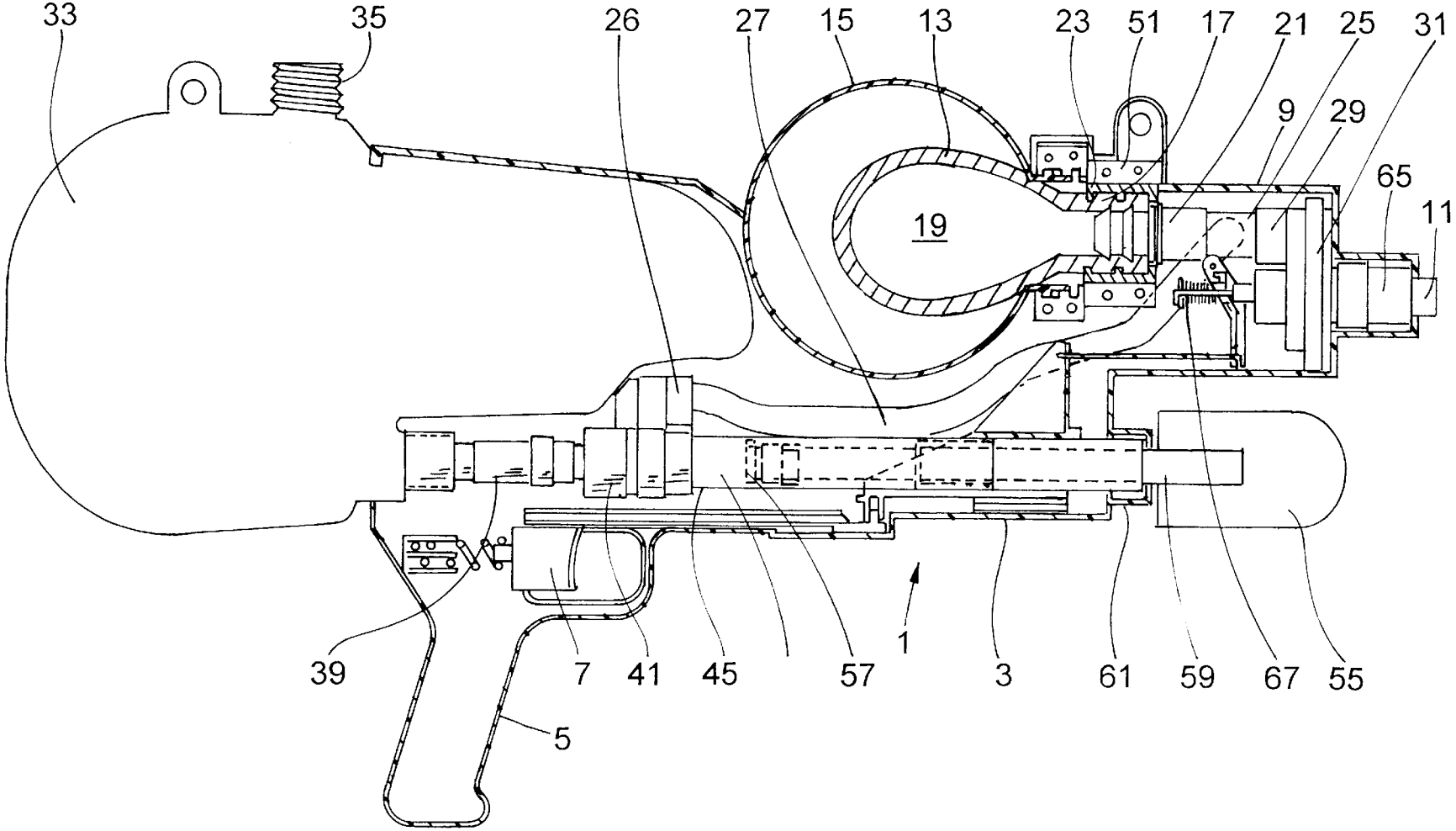
FIG. 1 shows a side cut view of a present invention toy water gun.
Figure 2:
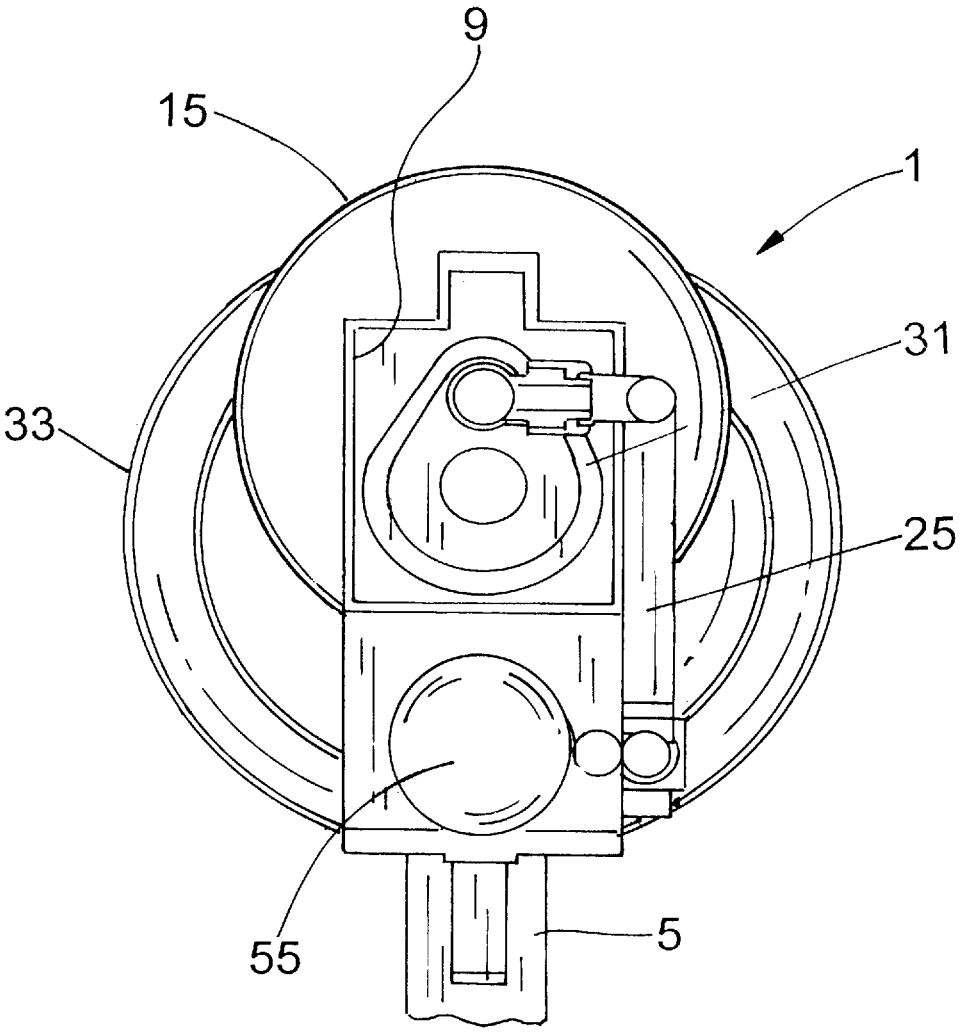
FIG. 2 shows a partial front cut view of the present invention toy water gun shown in FIG. 1 with the front of the barrel and nozzle removed; and, FIG. 3 shows a side cut view of the details of an unexpanded, present invention toy gun expandable, tear drop shaped bladder.

Referring now to FIGS. 1 and 2 collectively, the operation of the present invention embodiment can best be explained. FIG. 1 is a side view of the present invention embodiment toy gun 1 with main housing 3, handle 5, trigger 7 and barrel 9 with nozzle 11. FIG. 2 shows a partial front cut view of the present invention toy gun shown in FIG. 1 with the front of the barrel and nozzle removed.

Bladder 13 is located within bladder housing 15. Bladder 13 has an elongated, single inlet/outlet neck 17 and a tear drop shaped body 19. The tear drop shaped body has a first half being substantially hemispherical and a second half being substantially distorted, elongated hemispherical. Inlet/outlet neck 17 is connected to fluted inlet/outlet tube 21 by clamp 51 with internal ring projections such as projection 23. When tear drop shaped bladder 13 is filled with liquid, such as water, it expands consistently and evenly from a center point radially over the surface area of the body 19 of the bladder 13, and as confined within rigid bladder housing 15, expands into the substantially spherical shape of bladder housing 15. Inlet/outlet tube 21 is connected to a "y" connection 25 which is connected to tube 27, which is connected to a pump, described below. Connection 25 is also connected to tube 29 which is connected to a bladder release valve 31, discussed below.

The operation of present invention toy gun 1 is illustrated by reference to both FIGS. 1 and 2 simultaneously, with identical parts for both figures being identically numbered. FIG. 2 shows a partial front cut view, with the barrel front and nozzle removed. Toy gun 1 is operated by filling or partially filling tank 33 with water or other liquid through fill port 35 (after removal of a cap, not shown.) Tank 33, as shown, is connected to toy gun main housing 3, as shown. By "connected" is meant physically or fluidly connected to the gun directly or indirectly or internally contained therein or integrally formed therewith. A tank cap may be used which has a small vent hole to allow air entry but to discourage water leakage to prevent a vacuum from being formed in tank 33. Tank-to-pump tube 39 is connected to pump 45 and includes one-way valve 41 which permits water to enter into pump cylinder 47, but not back into tank 33. Movement of a piston 57 within the pump cylinder 47 forces movement of water to bladder 13 from tank 33. The piston 57 is operated by the pump rod 59 that connects the piston 57 to the slider handle 55. The pump rod 59 is anchored to the slider handle 55 and is slideably held in place by block 61.

The slider handle 55 is operated manually by the user. The user holds the slider handle 55 with one hand and the gun handle 5 with the other. The slider handle 55 is then moved back and forth along the length of its path, with block 61 acting as a stop. The back and forth action is transferred to the piston 57, which draws water or other liquid from tank 33 through tubing 39 and past one-way flow valve 41, into cylinder 47 on the outward stroke. On the inward stroke, water in cylinder 47 is forced (or pumped) through outwardly flowing one way valve 26, through tubing 27, through "y" connection 25, into tubing 21 and into the bladder 13 for expansion and filling thereof. Water may be pumped to the bladder 13 via pump 45 until the bladder 13 is filled. Water will also enter tube 29, but will not eject through the outlet tubing 65 and nozzle 11 because release valve 31 will be A closed until trigger 7, with release mechanism 67, is pulled. Once under expansion, the water in bladder 13 is prevented from flowing freely through the outlet tubing 65 by valve 31.

Figure 3:
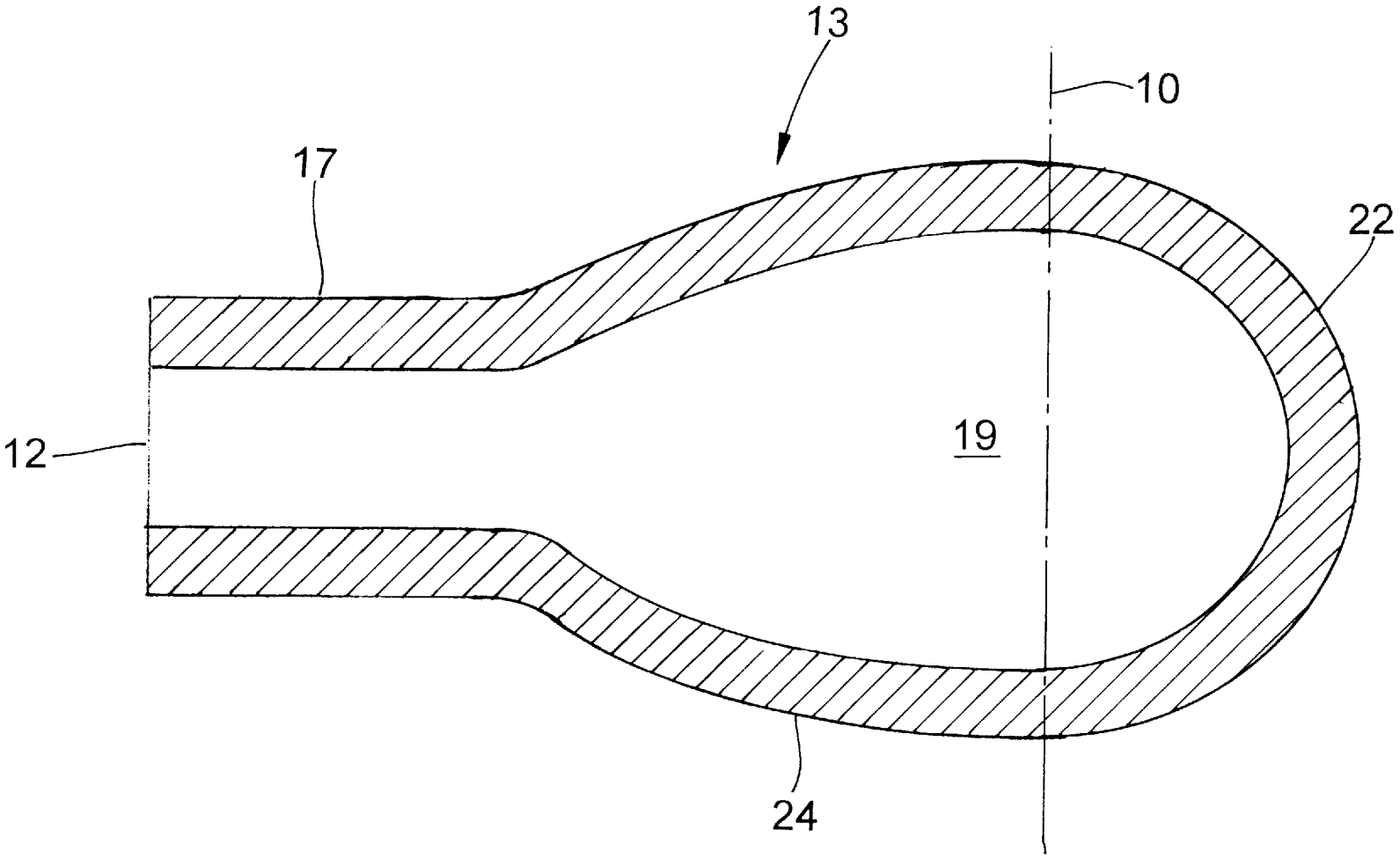

FIG. 3 shows a side cut view of an unexpanded, present invention toy gun expandable, tear drop shaped bladder 13. Bladder 13 includes a single inlet/outlet elongated neck 17 with open throat 12. It also includes means for attachment to an inlet/outlet tube.

Bladder 13 also includes a tear dropped shape body 19. Using imaginary center line 10 to divide bladder 13 into unequal halves, to the right of imaginary center line 10 is a first half 22 of body 19 which is substantially hemispherical, and to the left of imaginary center line 10 is a second half 24 which is substantially distorted, elongated hemispherical. In other words, second half 24 is an elongated hemisphere which is tapered. It might alternatively be characterized as a truncated, bowed cone. In any event, it can clearly be seen that first half 22 and second half 24 together form a tear drop shape.

It should now be recognized that preferred embodiment toy guns of the present invention having the enclosure about the bladder, will allow for repeat shots with the same burst of water and thus consistency in firing, until the bladder is substantially fully deflated. It has been found that the present invention tear shaped bladder-containing toy gun has unexpected results over toy guns with bladders of other shapes. Thus, the advantages of the tear shaped bladder include substantial uniform expansion, ease of manufacture compared to tube-shaped bladders, elimination of tapered wall thicknesses and consuming less space than tubular bladders. Additionally, the tear drop shape provides for expansion without the pinching or folding over of the rubber caused by nonuniform expansion which may occur with tubular bladders expanding forwardly and which may occur with ball shape bladders. Finally, in comparative tests, it was determined that the tear shaped bladders lasted 100% to 200% more fills than tubular bladders.

Obviously, numerous modifications and variations of the present invention are possible in light of the above teachings. It is therefore understood that within the scope of the appended claims, the invention may be practiced otherwise than as specifically described herein.

What is claimed is:

1. A toy gun having an expandable bladder for liquid ejection and having a trigger release mechanism for releasing liquid from the expandable bladder, the improvement comprising:

the expandable bladder having a tear drop shaped body with an outer surface, the tear drop shaped body having a first half and a second half, the first half being substantially hemispherical and the second half having a distorted, elongated hemispherical shape, the bladder having a first, non-expanded volume and a second, substantially spherical expanded volume; and a rigid, substantially spherical bladder housing having a predetermined volume which is approximately equal to the second, expanded volume of the bladder, the bladder being enclosed within the bladder housing, such that as the bladder is filled and expands to the second, substantially spherical expanded volume, the outer surface of the bladder contacts and is supported by the bladder housing.

2. The toy gun of claim 1, wherein the bladder has an elongated neck with a single inlet/outlet opening, and an attachment is located on the neck for connecting the bladder opening with an inlet/outlet tube located in the toy water gun to convey liquid to and from the bladder.

3. An expandable bladder toy water gun adapted to eject a stream of liquid, comprising:

(a) a main housing having a liquid ejection nozzle, a handle and a trigger located thereon;

(b) an expandable bladder connected to the main housing, the bladder having a tear drop shaped body with an elongated neck and a single inlet/outlet opening;

(c) a rigid, substantially spherical bladder housing connected to the main housing and encompassing the body of the tear drop shaped bladder, the bladder housing being generally spherical with a predetermined volume to contain the bladder when the tear drop shaped body is inflated to a maximum volume and expands into a substantially spherical shape within the predetermined volume to prevent further expansion of the bladder body within the bladder housing;

(d) an inlet/outlet tube connected to the inlet/outlet opening at the neck of the bladder;

(e) a liquid storage tank located on the main housing, the liquid storage tank including an outlet;

(f) a pump located on the main housing and connected to the tank, the pump being adapted to transfer liquid from the tank to the bladder through the inlet/outlet tube to expand and fill the bladder with liquid such that the bladder expands to the substantially spherical shape, wherein the expanded bladder provides a motive force for ejection of liquid from the toy gun; and (g) a bladder release valve having an upstream side and a downstream side, the upstream side being in fluid communication with the bladder inlet/outlet tube and the downstream side being connected to the nozzle, the release valve being actuatable by the trigger for opening thereof, the release valve having a first, closed position and a second, open position for ejection of pressurized liquid from the bladder through the nozzle.

4. The toy gun of claim 3 wherein the bladder release valve is normally in the first, closed position and is moved to the second, open position by activation of the trigger.

5. The toy gun of claim 3 wherein the pump is a piston chamber pump with a slider.

6. The toy gun of claim 5 wherein the pump comprises a one way pumping mechanism which includes a first one way valve which permits pressurization toward said bladder and prevents liquid from escaping from said pump away from said bladder.

7. The toy gun of claim 3, wherein the pump is located below the main housing.

8. The toy gun of claim 3, wherein the pump is connected to the bladder inlet/outlet tube via a single flow path, the single flow path also being connected to the bladder release valve such that the single flow path allows liquid to be transferred from the pump to the bladder as the pump is actuated and allows liquid to be transferred from the bladder to the release valve to allow liquid to be discharged from the toy gun upon actuation of the trigger.

9. The toy gun of claim 3, wherein the tear drop shaped body of the expandable bladder has a first half which is substantially hemispherical and a second half having a distorted, elongated hemispherical shape, the neck being part of the second half, the bladder having a body wall with a constant predetermined thickness to enhance a consistent radial rate of expansion as the bladder is filled with liquid, the bladder neck including a section having an outer diameter for attachment to the inlet/outlet tube.

10. An expandable bladder toy water gun adapted to eject a stream of liquid, comprising:

(a) a main housing having a liquid ejection nozzle, a handle and a trigger, and a release mechanism connected to the trigger;

(b) an expandable bladder connected to the main housing, the bladder having a tear drop shaped body with an elongated neck and a single inlet/outlet opening, the body being expandable from a first, unexpanded shape to a second, substantially spherical expanded shape;

(c) a rigid, substantially spherical bladder housing connected to the main housing and encompassing the body of the tear drop shaped bladder, the bladder housing being generally spherical with a predetermined volume to contain the bladder when the bladder body is inflated and expands to the second, substantially spherical shape within the predetermined volume to prevent further expansion of the bladder body within the bladder housing;

(d) an inlet/outlet tube connected to the inlet/outlet opening at the neck of the bladder;

(e) a liquid storage tank located on the main housing, the liquid storage tank including an outlet;

(f) a pump located on the main housing and connected to the tank and the inlet/outlet tube, the pump being adapted to transfer liquid from the tank to the bladder through the inlet/outlet tube to expand and fill the bladder with liquid such that the bladder expands to the second, substantially spherical shape, wherein the expanded bladder provides a motive force for ejection of liquid from the toy gun, the pump including a first one way valve which only permits pumping of liquid from the tank to the bladder; and (g) a bladder release valve having an upstream side and a downstream side, the upstream side being in fluid communication with the bladder inlet/outlet tube and the downstream side being connected to the nozzle, the release valve being connected by the release mechanism to the trigger for opening the release valve, the release valve having a first, closed position and a second, open position for ejection of pressurized liquid from the bladder through the nozzle.

11. The toy gun of claim 10 wherein the bladder release valve is normally in the first, closed position and is moved to the second, open position by the release mechanism connected to the trigger.

12. The toy gun of claim 10 wherein the pump is a piston chamber pump with a slider.

13. The toy gun of claim 10, wherein the pump is located below the main housing.

14. The toy gun of claim 10, wherein the pump is connected to the bladder inlet/outlet tube via a single flow path, the single flow path also being connected to the bladder release valve such that the single flow path allows liquid to be transferred from the pump to the bladder as the pump is actuated and allows liquid to be transferred from the bladder to the release valve to allow liquid to be discharged from the toy gun as the trigger is actuated.

15. The toy gun of claim 10, wherein the tear drop shaped body of the expandable bladder has a first half which is substantially hemispherical and a second half having a distorted, elongated hemispherical shape, the neck being part of the second half, the bladder having a body wall with a constant predetermined thickness to enhance a consistent radial rate of expansion as the bladder is filled with liquid, the bladder neck including a section having an outer diameter for attachment to the inlet/outlet tube.

* * * * *